US010697234B2

(12) United States Patent
Chen

(10) Patent No.: US 10,697,234 B2
(45) Date of Patent: Jun. 30, 2020

(54) WINDOW BLIND

(71) Applicant: Chin-Fu Chen, Taichung (TW)

(72) Inventor: Po-Yu Chen, Taichung (TW)

(73) Assignee: Chin-Fu Chen, Taichung (TW)

( * ) Notice: Subject to any disclaimer, the term of this patent is extended or adjusted under 35 U.S.C. 154(b) by 186 days.

(21) Appl. No.: 15/871,512

(22) Filed: Jan. 15, 2018

(65) Prior Publication Data

US 2018/0274290 A1 Sep. 27, 2018

(30) Foreign Application Priority Data

Mar. 23, 2017 (TW) ..... 106109767 A

(51) Int. Cl.

| | |
|---|---|
| ***E06B 9/303*** | (2006.01) |
| ***E06B 9/322*** | (2006.01) |
| ***E06B 9/306*** | (2006.01) |
| ***E06B 9/323*** | (2006.01) |
| ***E06B 9/307*** | (2006.01) |

(52) U.S. Cl.

CPC ..... *E06B 9/322* (2013.01); *E06B 9/303* (2013.01); *E06B 9/306* (2013.01); *E06B 9/307* (2013.01); *E06B 9/323* (2013.01)

(58) Field of Classification Search

CPC ..... E06B 9/322; E06B 9/303; E06B 9/304; E06B 2009/3222; E06B 9/307; E06B 9/308; E06B 9/323; E06B 9/382; E06B 9/32; E06B 9/324; E06B 9/325

See application file for complete search history.

(56) References Cited

U.S. PATENT DOCUMENTS

| | | | | |
|---|---|---|---|---|
| 4,651,794 | A | 3/1987 | Bytheway, Jr. | |
| 4,667,723 | A * | 5/1987 | Spangenberg | E06B 9/324 160/178.2 |
| 5,692,552 | A | 12/1997 | Judkins | |
| 6,095,228 | A * | 8/2000 | Liu | E06B 9/307 160/173 R |
| 6,179,035 | B1 | 1/2001 | Anderson | |
| 6,189,596 | B1 * | 2/2001 | Chen | E06B 9/303 160/176.1 R |
| 7,025,107 | B2 * | 4/2006 | Ciuca | E06B 9/303 160/170 |
| 9,482,049 | B2 | 11/2016 | Chen | |

(Continued)

*Primary Examiner* — Katherine W Mitchell
*Assistant Examiner* — Jeremy C Ramsey
(74) *Attorney, Agent, or Firm* — Browdy and Neimark, PLLC

(57) ABSTRACT

A window blind includes top and bottom beams, and many slats disposed therebetween. The top beam has two opposite lateral holes. The window blind further includes a slat folding transmission device having a cord rolling member disposed in the top beam, and two opposite lift transmission cords passing through the lateral holes of the lateral plates of the top beam respectively. Two ends of each lift transmission cord are connected with the bottom beam and the cord rolling member respectively, so that the two lift transmission cords can pull the bottom beam simultaneously when being rolled by the cord rolling member, thereby moving the bottom beam upwardly to fold up the slats. Therefore, the slats of the window blind of the invention need no processing and keep complete in structure, thereby providing good effect of blocking out the light when being adjusted to the inclined condition.

3 Claims, 4 Drawing Sheets

(56) References Cited

U.S. PATENT DOCUMENTS

| | | | | |
|---|---|---|---|---|
| 9,689,199 | B1 * | 6/2017 | Chen | E06B 9/327 |
| 2004/0188038 | A1 * | 9/2004 | Nien | E06B 9/303 160/168.1 R |
| 2006/0289124 | A1 * | 12/2006 | Tsai | E06B 9/303 160/178.3 |
| 2015/0211292 | A1 * | 7/2015 | Chang | E06B 9/323 160/168.1 R |
| 2016/0281421 | A1 * | 9/2016 | Huang | E06B 9/324 |
| 2017/0175439 | A1 | 6/2017 | Chen | |
| 2017/0292322 | A1 * | 10/2017 | Chen | B65H 75/4434 |
| 2018/0073295 | A1 | 3/2018 | Nien | |
| 2018/0291679 | A1 * | 10/2018 | Zheng | E06B 9/322 |
| 2019/0071925 | A1 * | 3/2019 | Zhang | E06B 9/307 |

* cited by examiner

WINDOW BLIND

BACKGROUND OF THE INVENTION

1. Field of the Invention

The present invention relates to window blinds and more particularly to a window blind which is good in the effect of blocking out the light.

2. Description of the Related Art

As to the conventional window blind as shown in FIG. 1, the bottom beam can control the folding up of the slats 3 by being pulled by at least two cords 2. These cords 2 are all extended out from the bottom of the top beam 1, pass through every slat 3, and then fixed to the bottom beam. Therefore, every slat 3 should be processed to be provided with through holes 4 for the cords 2 to pass therethrough. But these through holes 4 will affect the slats' 3 effect of blocking out the light when the slats 3 are adjusted to the inclined condition, so the conventional window blind still needs improvement.

SUMMARY OF THE INVENTION

It is a primary objective of the present invention to provide a window blind, the slats of which is complete in structure, thereby good in the effect of blocking out the light.

To attain the above objective, the window blind of the present invention includes a bottom beam, a top beam, a plurality of slats, and a slat folding transmission device. The top beam has a bottom plate and two lateral plates connected to two opposite long sides of the bottom plate respectively and provided with a lateral hole each. The slats are disposed between the top beam and the bottom beam in a way that the slats are spaced out from each other. The slat folding transmission device has a cord rolling member and two lift transmission cords opposite to each other. The cord rolling member is disposed in the top beam. The two lift transmission cords pass through the lateral holes of the lateral plates of the top beam respectively, and are located adjacent to two opposite long sides of each of the slats respectively. An end of each of the two lift transmission cords is connected with the bottom beam. Another end of each of the two lift transmission cords is connected with the cord rolling member, so that the two lift transmission cords can pull the bottom beam simultaneously when being rolled by the cord rolling member, thereby moving the bottom beam upwardly to fold up the slats by pushing the slats.

It can be known from the above description that the slats of the window blind of the present invention have no need to be provided with holes by processing, thereby complete in structure, so that the slats can provide good effect of blocking out the light when being adjusted to the inclined condition.

Preferably, the slat folding transmission device further has a cord guiding seat having two first vertical walls opposite to each other, two second vertical walls opposite to each other, two first guiding rods opposite to each other, and two second guiding rods opposite to each other; the two first vertical walls are embedded in the lateral holes of the lateral plates of the top beam respectively, and provided with a first cord passing hole each; each said first cord passing hole is passed through by a said lift transmission cord; the two second vertical walls are located between the two first vertical walls and disposed adjacent to the first vertical walls respectively; each of the first guiding rods is disposed in the first cord passing hole of a said first vertical wall horizontally and abutted against a said lift transmission cord; each of the second guiding rods is disposed between a said first vertical wall and a said second vertical wall inclinedly and abutted against a said lift transmission cord. Such structural arrangement can improve the functional smoothness of the two lift transmission cords.

Preferably, the bottom plate of the top beam has two bottom holes opposite to each other; the window blind further includes a slat angle adjusting device having an angle adjusting rod, an angle adjusting seat, two adjusting cords and a plurality of holding circles; the angle adjusting rod is disposed in the top beam revolvably on its own axis; the angle adjusting seat is connected with the angle adjusting rod and pivotably disposed on the cord guiding seat; the two adjusting cords pass through the bottom holes of the bottom plate of the top beam respectively, and are located adjacent to said two opposite long sides of each of the slats respectively; an end of each of the two adjusting cords is connected with the angle adjusting seat; another end of each of the two adjusting cords is connected with the bottom beam; each of the holding circles is connected between the two adjusting cords and put around a said slat. In this way, the angle adjusting seat can pull one of the two adjusting cords when being driven by the angle adjusting rod, to incline the slats to achieve the effect of blocking out the light.

Preferably, the cord guiding seat has a bottom wall connecting the two first vertical walls and the two second vertical walls; the bottom wall is provided at each of two ends thereof with a second cord passing hole; each said second cord passing hole communicates with a said bottom hole of the bottom plate of the top beam, and is passed through by a said adjusting cord. Such structural arrangement can improve the moving smoothness of the adjusting cords.

Preferably, each of the adjusting cords is connected with a plurality of limiting circles spaced out from each other and passed through by a said lift transmission cord at the same time, such that the lift transmission cords and the adjusting cords are prevented from entwining or interfering with each other.

The detailed structure, features and assembling or using manner of the window blind of the present invention will be specified in the detailed description of the embodiments given hereinafter. However, those skilled in the field of the present invention should understand that the detailed description and the specific embodiments instanced for the implementing of the invention are given for illustration only, not for limiting the scope of the invention.

DETAILED DESCRIPTION OF THE INVENTION

Figure 1:
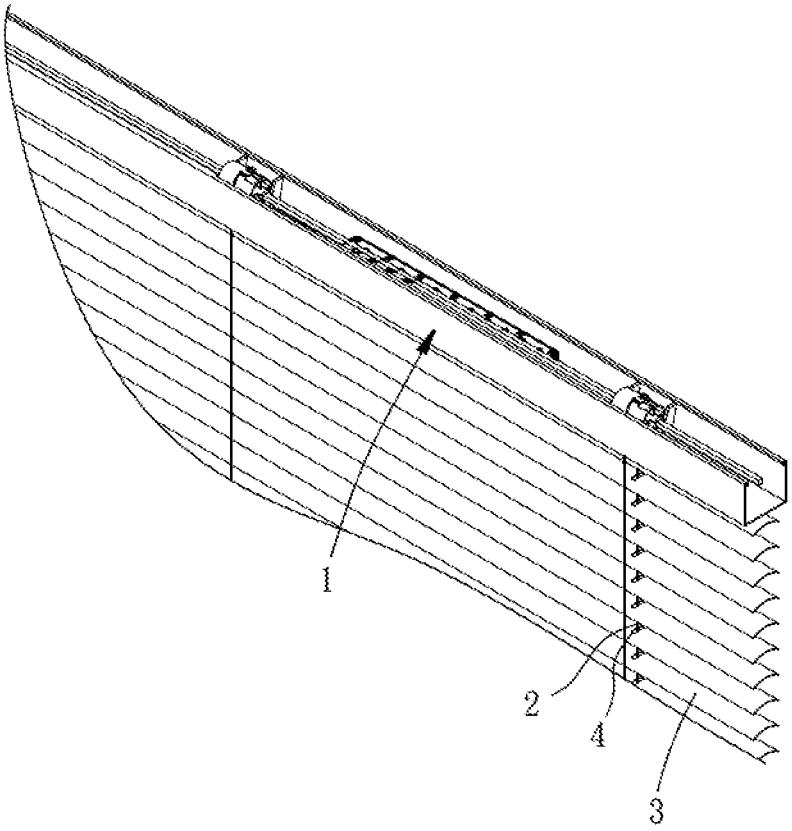
FIG. 1 PRIOR ART
FIG. 1 is a perspective view of the partial appearance of the conventional window blind.
Figure 2:
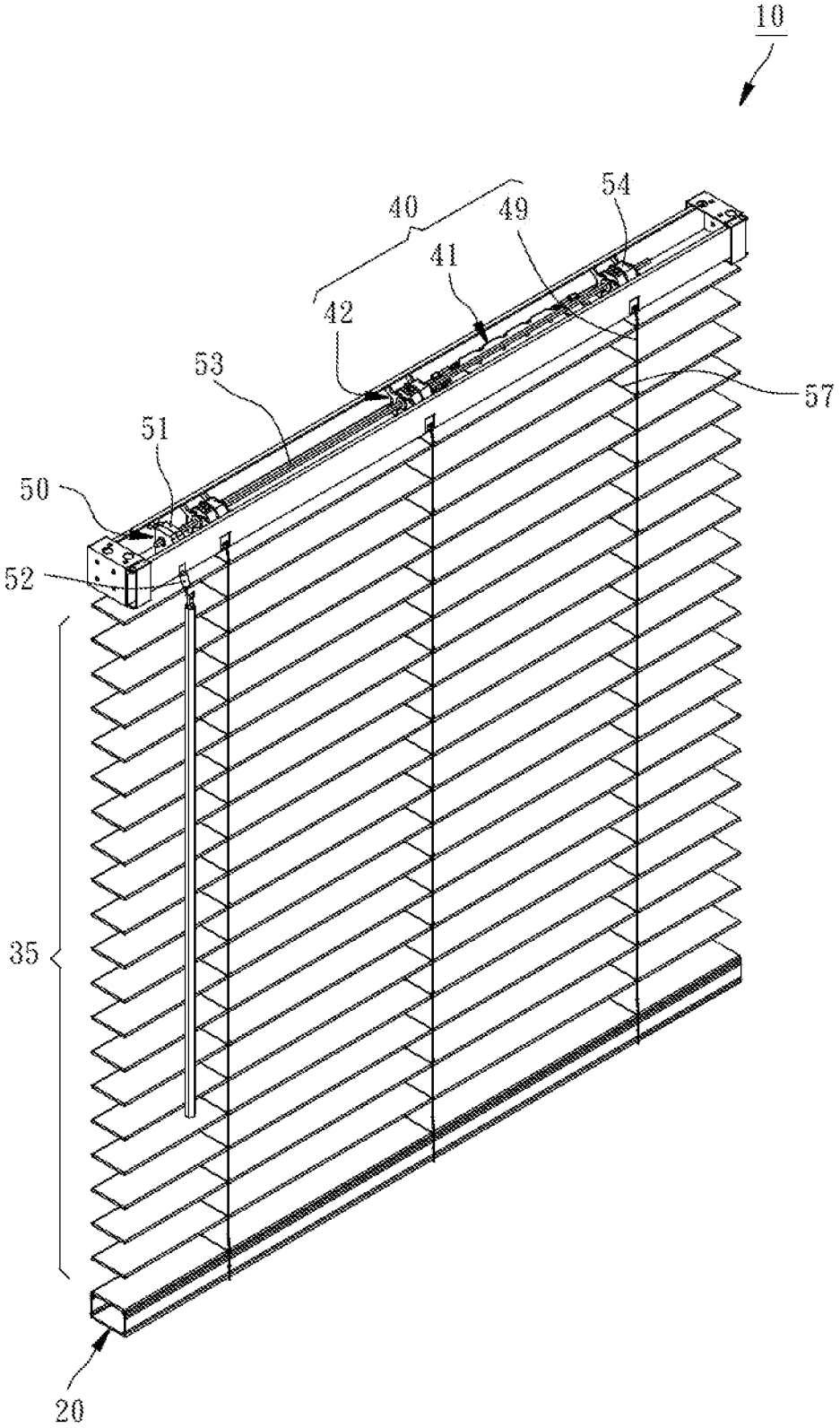
FIG. 2 is a perspective view of the appearance of the window blind of the present invention.

First of all, it is to be mentioned that the window blind 10 of the present invention may be the window blind with a pulling cord or the window blind with no pulling cord. In this embodiment, it is primarily about the window blind with no pulling cord. Referring to FIG. 2, the window blind 10 of the present invention includes a bottom beam 20, a top beam 30, a plurality of slats 35, a slat folding transmission device 40, and a slat angle adjusting device 50.

Figure 4:
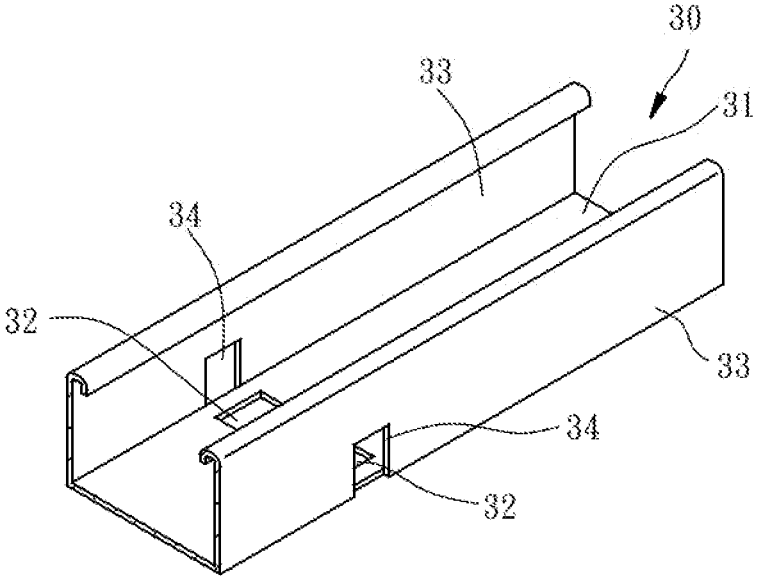
FIG. 4 is a perspective view of the partial appearance of a top beam of the window blind of the present invention.

The top beam 30 is located above the bottom beam 20, and has a bottom plate 31 and two lateral plates 33, as shown in FIG. 4. The bottom plate 31 is provided at each of two ends and the center thereof with a pair of rectangular bottom holes 32. The two lateral plates 33 are connected to two opposite long sides of the bottom plate 31 respectively, and each have three rectangular lateral holes 34 located correspondingly to the bottom holes 32.

The slats 35 are disposed between the bottom beam 20 and the top beam 30 in a way that the slats 35 are spaced out from each other.

Figure 3:
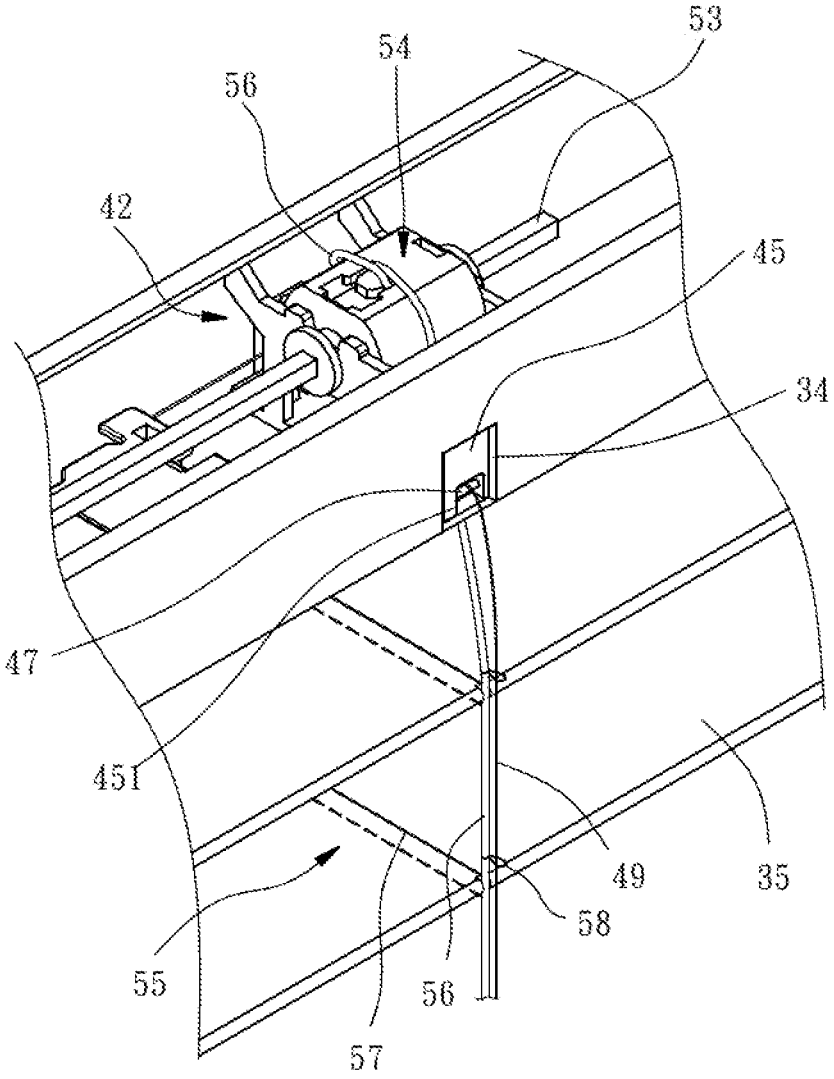
FIG. 3 is an enlarged view of a part of the window blind of the present invention.
Figure 5:
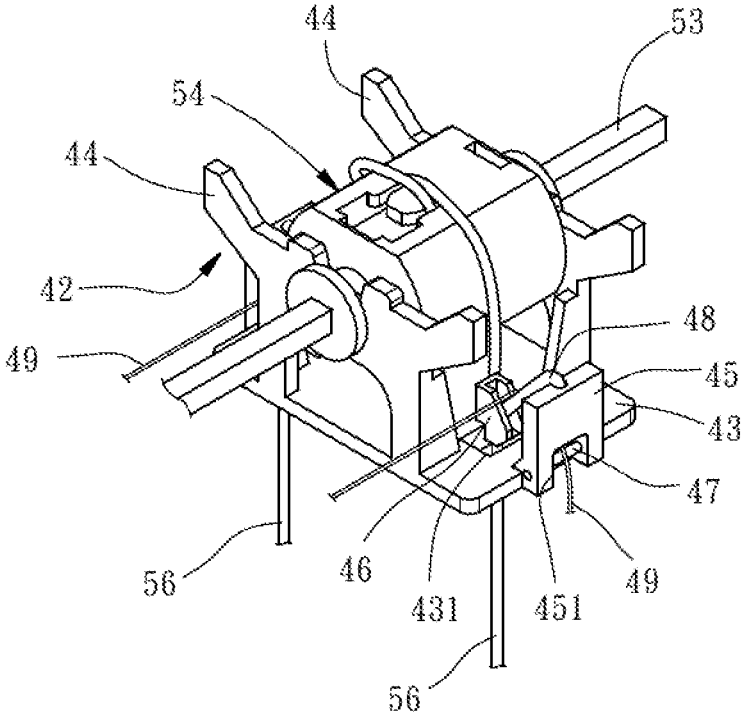
FIG. 5 is a perspective view of the appearance of a cord guiding seat and an angle adjusting seat of the window blind of the present invention.

The slat folding transmission device 40 has a cord rolling member 41, three cord guiding seats 42, and three pairs of lift transmission cords 49. The cord rolling member 41 is disposed in the top beam 30, as shown in FIG. 2, for rolling and relieving the lift transmission cords 49. Detailed structure of the cord rolling member 41 can be known by reference to U.S. Pat. No. 9,435,153 (curtain body locating mechanism 18), U.S. Pat. No. 9,482,049 (curtain body locating mechanism 12) and U.S. Pat. No. 9,366,077 (blind body positioning mechanism 18) applied by the applicant of the present invention and incorporated by reference herein, that will not be repeatedly mentioned hereunder. As shown in FIGS. 3 and 5, each cord guiding seat 42 has a bottom wall 43, two lateral walls 44 opposite to each other, two first vertical walls 45 opposite to each other, two second vertical walls 46 opposite to each other, two first guiding rods 47 opposite to each other, and two second guiding rods 48 opposite to each other. The bottom wall 43 is provided at each of two opposite ends thereof with a second cord passing hole 431 communicating with the bottom hole 32 of the bottom plate 31 of the top beam 30. The two lateral walls 44 are connected to two opposite long sides of the bottom wall 43 respectively. The two first vertical walls 45 are connected to two opposite short sides of the bottom wall 43 respectively, embedded in the lateral holes 34 of the lateral plates 33 of the top beam 30 respectively, and provided with a first cord passing hole 451 each. The two second vertical walls 46 are connected to two opposite ends of the bottom wall 43 respectively, located between the two first vertical walls 45, and disposed adjacent to the second cord passing holes 431 of the bottom wall 43 respectively. The first guiding rod 47 is disposed on inner walls of the first cord passing hole 451 of the first vertical wall 45 horizontally. The second guiding rod 48 is disposed between the first and second vertical walls 45 and 46 inclinedly. An end of the lift transmission cord 49 is connected with the bottom beam 20. The other end of the lift transmission cord 49 is connected with the cord rolling member 41. Besides, the lift transmission cord 49 passes through the first cord passing hole 451 of the first vertical wall 45 of the cord guiding seat 42, and is abutted against the first and second guiding rods 47 and 48 when being moved, so that the first and second guiding rods 47 and 48 can improve the functional smoothness of the lift transmission cords 49.

As shown in FIGS. 2, 3 and 5, the slat angle adjusting device 50 has a driving set 51, an angle adjusting rod 53, three angle adjusting seats 54, and three adjusting cord sets 55. The driving set 51 is disposed in the top beam 30, and has a handling portion 52 extended out of the top beam 30. The angle adjusting rod 53 is disposed in the top beam 30 and connected with the driving set 51, so that the angle adjusting rod 53 can be driven by the driving set 51 to revolve on its own axis. The angle adjusting seats 54 are respectively disposed on the cord guiding seats 42 in a way that each angle adjusting seat 54 is pivotably connected between the two lateral walls 44 of the associated cord guiding seat 42 and connected with the angle adjusting rod 53, so that the angle adjusting seats 54 are rotatable relative to the cord guiding seats 42 together with the angle adjusting rod 53. Each adjusting cord set 55 has two adjusting cords 56 opposite to each other, and a plurality of holding circles 57. Two ends of each of the two adjusting cords 56 are connected with the angle adjusting seat 54 and the bottom beam 20 respectively. Besides, the two adjusting cords 56 pass through the bottom holes 32 of the bottom plate 31 of the top beam 30 via the second cord passing holes 431 of the bottom wall 43 of the cord guiding seat 42 respectively, and are located adjacent to two opposite long sides of each of the slats respectively, so that the two adjusting cords 56 have good moving smoothness. The holding circles 57 are connected between the two opposite adjusting cords 56 and put around the slats 35 respectively. Besides, each adjusting cord 56 is connected with a plurality of limiting circles 58 spaced out from each other, and the limiting circles 58 located on the same adjusting cord 56 are put around the same lift transmission cord 49, so that the lift transmission cords 49 and the adjusting cords 56 are prevented from entwining or interfering with each other.

When the slats 35 are to be folded up, the upward pushing force applied by the user to the bottom beam 20 and the rolling force applied by the cord rolling member 41 to the lift transmission cords 49 move the bottom beam 20 toward the top beam 30. In the process that the bottom beam 20 is moved toward the top beam 30, all the slats 35 are piled on one another and at last folded up. On the other hand, when the slats 35 are to be adjusted to the inclined condition, at first the handling portion 52 of the driving set 51 is rotated, and the driving set 51 drives the angle adjusting rod 53 to rotate. In the process of rotation, the angle adjusting rod 53 further drives the angle adjusting seats 54 to rotate, so that the angle adjusting seats 54 pulls one of the adjusting cords 56 of each adjusting cord set 55. Then, the pulled adjusting cords 56 upwardly push the associated long sides of the slats 35 through the holding circles 57, so that the slats 35 come into the inclined condition to provide the effect of blocking out the light.

It can be known from the above description that the slats 35 of the window blind 10 of the present invention have no need to be provided with holes by processing, thereby complete in structure, so that the slats 35 can provide good effect of blocking out the light when being adjusted to the inclined condition. Besides, the adjusting cords 56 and the lift transmission cords 49 of the window blind 10 of the present invention are improved in the moving smoothness, and prevented from entwining or interfering with each other, so that the window blind 10 of the present invention is effectively improved in the operational stability.

What is claimed is:

1. A window blind comprising:

a bottom beam;

a top beam having a bottom plate and two lateral plates connected to two opposite long sides of the bottom plate respectively and provided with a lateral hole each;

a plurality of slats disposed between the top beam and the bottom beam in a way that the slats are rotatable simultaneously; and a slat folding transmission device being disposed in the top beam and having a cord rolling member and two lift transmission cords opposite to each other, said two lift transmission cords passing through the lateral holes of the lateral plates of the top beam respectively and being located adjacent to two opposite long sides of each of the slats respectively; an end of each of the two lift transmission cords is connected with the bottom beam; an opposite end of each of the two lift transmission cords is connected with the cord rolling member;

wherein the slat folding transmission device further has a cord guiding seat having two first vertical walls opposite to each other, two second vertical walls opposite to each other, two first guiding rods opposite to each other, and two second guiding rods opposite to each other; the two first vertical walls are embedded in the lateral holes of the lateral plates of the top beam respectively, and provided with a first cord passing hole each; each said first cord passing hole is passed through by a respective lift transmission cord of said two lift transmission cords; the two second vertical walls are located between the two first vertical walls and disposed adjacent to the first vertical walls respectively; each of the first guiding rods is horizontally disposed in the first cord passing hole of a respective first vertical wall and abutted against a respective lift transmission cord of said two lift transmission cords; each of the second guiding rods is inclined between a respective first vertical wall and a respective second vertical wall and abutted against a respective lift transmission cord of said two lift transmission cords;

wherein the bottom plate of the top beam has two bottom holes opposite to each other; the window blind further comprises a slat angle adjusting device having an angle adjusting rod, an angle adjusting seat, two adjusting cords and a plurality of holding tubes; the angle adjusting rod is disposed in the top beam revolvably on its own axis; the angle adjusting seat is connected with the angle adjusting rod and pivotably disposed on the cord guiding seat; the two adjusting cords pass through the bottom holes of the bottom plate of the top beam respectively, and are located adjacent to said two opposite long sides of each of the slats respectively; an end of each of the two adjusting cords is connected with the angle adjusting seat; an opposite end of each of the two adjusting cords is connected with the bottom beam; each of the holding tubes is connected between the two adjusting cords and put around a respective slat of the plurality of slats.

2. The window blind as claimed in claim 1, wherein the cord guiding seat has a bottom wall connecting the two first vertical walls and the two second vertical walls; the bottom wall is provided at each of two ends thereof with a second cord passing hole located adjacent to the second vertical wall; each said second cord passing hole communicates with a respective bottom hole of the bottom plate of the top beam, and is passed through by a respective adjusting cord of the two adjusting cords.

3. The window blind as claimed in claim 1, wherein each of the adjusting cords is connected with a plurality of limiting tubes spaced out from each other; the limiting tubes located on the same adjusting cord are passed through by the same lift transmission cord.

* * * * *